United States Patent [19]

Barstow

[11] Patent Number: 4,711,406

[45] Date of Patent: Dec. 8, 1987

[54] COREHOLDER

[76] Inventor: Kenneth T. Barstow, 234 Axminister Dr., Fenton, Mo. 63026

[21] Appl. No.: 869,272

[22] Filed: Jun. 2, 1986

[51] Int. Cl.[4] ..... B65H 75/24; B23B 31/40; B25G 3/28

[52] U.S. Cl. ..... 242/72 R; 242/68.2; 279/2 R; 403/279

[58] Field of Search ..... 242/72 R, 72.1, 68.2; 403/297, 250; 279/2 R, 30

[56] References Cited

U.S. PATENT DOCUMENTS

| | | | |
|---|---|---|---|
| 1,527,539 | 10/1921 | Damon . | |
| 1,858,753 | 4/1931 | Taylor . | |
| 2,507,577 | 8/1947 | Reynolds . | |
| 2,908,452 | 10/1959 | Jacobsen | 242/72 R |
| 3,115,798 | 12/1963 | Donaway | 279/2 R X |
| 3,118,683 | 1/1964 | Hoshizaki | 279/2 R |
| 3,437,362 | 4/1969 | Offenbroich | 403/297 |
| 3,469,823 | 9/1969 | Blum et al. | 403/297 X |
| 3,782,740 | 1/1974 | Peyrot | 279/2 R |
| 4,322,190 | 3/1982 | Anderson | 279/2 R X |
| 4,334,652 | 6/1982 | Blackburn | 242/72 R |
| 4,339,094 | 7/1982 | Thievessen et al. | 242/72 R X |

*Primary Examiner*—Stuart S. Levy
*Assistant Examiner*—Thomas R. Hannon
*Attorney, Agent, or Firm*—Kalish & Gilster

[57] ABSTRACT

A coreholder for securely holding web cores and the like for winding or unwinding includes a cylindrical body surrounded by an expandable sleeve for receiving a core with the sleeve extending within the central opening of the core. Grooves along the body surface beneath the sleeve hold balls of uniform diameter. The balls extend along the lengths of the grooves in contiguous relationship such that at least some of the balls are forced radially outwardly toward the sleeve for applying pressure thereto upon pressure being exerted relatively between the balls. One of the grooves opens from the body at one end for exposing an end one of the balls to selectively applied pressure by a tightening knob to transfer pressure to others of the balls, causing the balls to apply pressure to the sleeve for causing it to expand outwardly for uniformly and grippingly engaging interior surfaces of the core central opening.

9 Claims, 5 Drawing Figures

COREHOLDER

BACKGROUND AND SUMMARY OF THE INVENTION

This invention relates to devices for handling cores upon which webs of paper or other materials are to be wound and, more particularly, to an improved coreholder for facilitating the rapid securement, winding or unwinding of a core by rotation thereof, and for removal thereafter.

There have been proposed many different bushings, reel holders or grabbers, or so called coreholders. In one such prior art type of coreholder, a cam or eccentric may be rotated for selectively engaging the inner diameter of a core to be received. Such cores, as used to hold webs of paper, fabric or other material such as will be fed into a printing process, as in the manufacture of printed labels, are of material which can be caused to distort as the eccentric or coreholding mechanism is expanded or extended into its core-engaging position. The resultant distortion and eccentricity of the tape roll causes the tape roll to surge or undergo positive and negative acceleration during each rotation of the coreholder, and this can in turn result in registry problems during printing. Another problem of such prior arrangements is that the core-engaging mechanism sometimes becomes loosened. The resultant inertia of the rotating roll will cause it to spin relative to the coreholder, and this can cause tape to become unrolled and to spill from the core, since the drive mechanism can no longer exert a braking force on the roll.

Among the prior art may be noted the following references: Damon U.S. Pat. No. 1,527,539; Taylor U.S. Pat. No. 1,858,753; and Reynolds U.S. Pat. No. 2,507,577.

The Damon patent discloses a spindle which includes a plurality of bars urged outwardly from a spindle assembly, the bars being selectively moveable radially in or out for selective engagement of the interior surfaces of a core or reel. However, the surface area of such bars is limited and thus there is potential for slippage or lack of secure engagement of the core or reel. Further, the bars in such an arrangement undergo longitudinal translation in movement between the retracted and extended, core-engaging positions, and such movement is disadvantageous. The Taylor patent reveals an expansible bushing for winding cores having a wedge-shaped key intended to be forced progressively between two halves of the bushing to expand the bushing outwardly for engaging the inner surfaces of the core. It is found, however, that such a wedge produces an inherent distortion of the bushing which, as a result, does not exhibit a uniform diameter or concentricity relative to the axis of rotation. Accordingly, the core is similarly distorted upon expansion of the bushing, with all of the foregoing disadvantages.

The Reynolds patent proposes an expanding arbor type reel grab having a series of rollers on opposite sides of a wedge-shaped tapered arbor which, by means of a lever-actuated mechanism, may be caused to be displaced along the surface of the tapered surfaces of the tapered arbor for outwardly expanding two halves of the core. In addition to being prohibitively complex, this construction is of relatively massive configuration and has a cumbersome and complicated tightening mechanism having dangerous extending elements which constitute a hazard to personnel when the core is rotating.

Accordingly, it is among the several objects of the present invention may be noted the provision of an improved coreholder which is of simple and highly effective construction; which provides uniform expansion of core-engaging elements; which is inherently self-equalizing; which utilizes conventionally-available, highly precise elements in its construction; which securely and reliably engages a core to prevent the same from rotating relative to the coreholder; which permits simple, facile tightening for rapid mounting of a core, and equally simply, facile removal of the core; and which does not provide objectionable eccentricity or rotational acceleration of the core, when engaged upon the coreholder, during rotation.

Briefly, the new coreholder of the invention, as used for securely holding web cores and the like for winding and unwinding thereof, comprises a body of generally cylindrical configuration. An expandable sleeve surrounds the body for receiving a core with the sleeve extending within the central opening of the core. The body defines grooves along its surface beneath the sleeve, and a plurality of balls, as most preferably in the form of ball bearings, of uniform diameter, extend along the lengths of the grooves in contiguous relationship such that some of the balls will be forced radially outwardly toward the sleeve for applying pressure thereto upon pressure exerted relatively between the balls. At least one of the grooves opens from the body at one end thereof for exposing an end one of the balls. Means is provided for selectively applying pressure against the exposed ball to transfer pressure to others of the balls for causing the balls to apply pressure to the sleeve for producing outward expansion thereof for uniformly and grippingly engaging interior surfaces of the core central opening.

Other objects and features will be in part apparent and in part pointed out hereinbelow.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
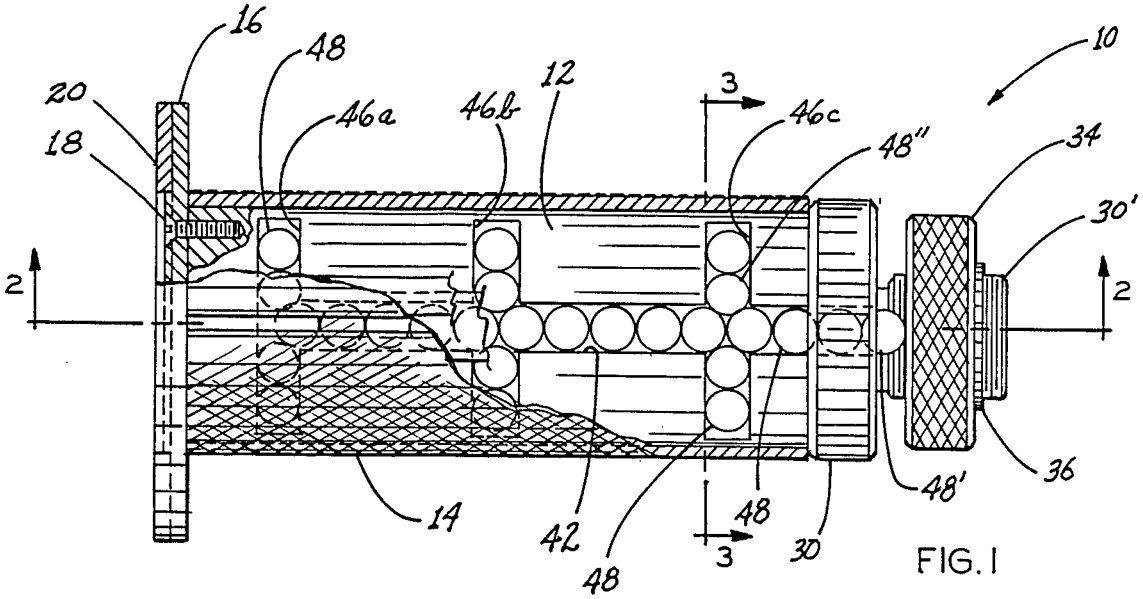
FIG. 1 is a plan view of a coreholder of the invention, partly broken away.
Figure 2:
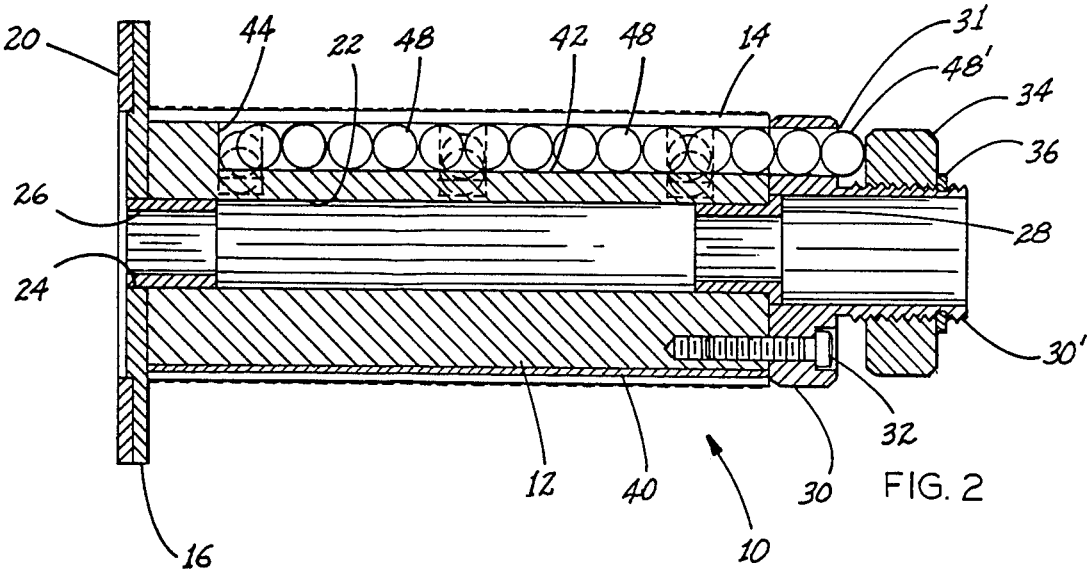
FIG. 2 is a horizontal cross section taken along line 2—2 of FIG. 1.
Figure 3:
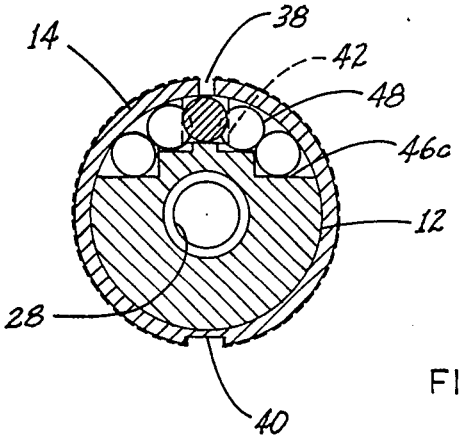
FIG. 3 is a vertical cross section taken along line 3—3 of FIG. 1.

Referring now to the drawings, and particularly FIGS. 1-3, designated in its entirety generally at reference numeral 10 is a coreholder of the invention, such as particularly suited for receiving, and holding secure, a core on which webs of paper or other materials are wound or to be wound such as during a printing process. It is to be understood that such a web or tape may vary in width from one to several inches, so that coreholder 10 is intended to accomodate a paper or synthetic resin material core of various possible widths.

The new coreholder comprises a coreholder body 12 of cylindrical overall configuration. Surrounding the body is a sleeve of 14 which, for reasons which will be shortly apparent, is expandable. The sleeve is intended for receiving the core or other device having a circular central opening with the sleeve extending within such central opening. At one end of body 12 is a circular flange 16, being affixed to the coreholder body by flathead socket cap machine screws 18. The core received upon sleeve 14 is moved toward flange 16 until it comes to rest against the body-adjacent surface thereof. Secured, as most preferably by adhesive, to the outer surface of flange 16 is an annular disk 20 of frictional material by which drive apparatus may apply rotational frictional forces to coreholder 10 for its rotational acceleration and deceleration.

Body 12 is provided with an internal central longitudinal bore 22 extending along its length. Concentric with bore 22, which is of circular section, is a circular recess 24 of the same diameter provided within flange 16. Fitted through opening 24 and extending partially into bore 22 is a cylindrical bearing 26 which serves as the inner bearing of the coreholder for mounting same upon a shaft for rotation. Similarly, fitted into bore 22 at its outer end is a flanged bearing 28 which thereby serves as the outer bearing of the coreholder assembly.

Fitted to coreholder body 12 at its outer end, in concentric relation to flanged outer bearing 28, is an end cap 30 of annular configuration. It is held in place by a plurality of socket head cap screws, as at 32, which are threaded into the coreholder body. End cap 30 includes an externally threaded collar 30' upon which is threaded a tightening knob 34 to be selectively turned in either a tightening direction, for expansion of sleeve 14 to secure a core upon the coreholder, or in a loosening direction to permit removal of the core. Knob 34 is knurled for being securely gripped by hand.

Seated within a groove at the outer end of collar 30' is a snap ring 36 to prevent knob 34 from being removed when loosening. The outer surface of sleeve 14 is similarly knurled for providing increased friction between it and a received core, and especially providing a surface that will "self adjust" to slight variations in inside diameters of adjacent paper cores.

Figure 4:
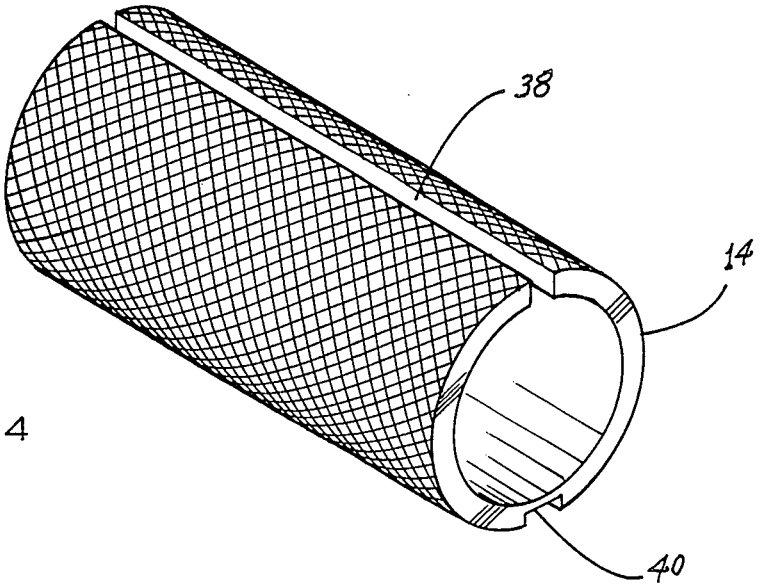
FIG. 4 is a perspective view of an expandable sleeve forming part of the coreholder of FIG. 1.

Referring also to FIG. 4, sleeve 14 is split along its length to provide a narrow gap 38 formed between opposing edges of the sleeve when unexpanded. Diametrically opposite from gap 38 is a narrow external groove 40 extending along the length of the sleeve thereby providing a reduced thickness area having increased flexibility to permit outward expansion of the sleeve in the manner described below by flexible bending within the reduced thickness material. The groove 40 also provides a location to recess a scale or indicator so that cores may be located in proper lateral position.

Figure 5:
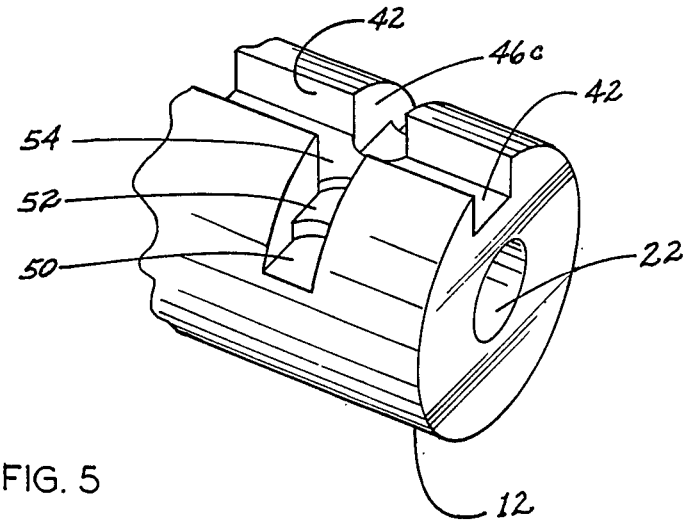
FIG. 5 is a fragmentary perspective view of portions of a body of the coreholder of FIG. 1, and particularly illustrating the provision of slots therein for receiving sets of balls which are urged against each other within the slots to cause expansion of the sleeve of FIG. 4.

Referring now also to FIG. 5, the coreholder body 12 has machined into it a longitudinal slot or groove 42 which opens outwardly from the core body but is closed at an inner end 44. Transecting groove 42 are three lateral grooves **46*a*, 46*b*, 46*c* which also are of rectangular section and extend in opposite directions across longitudinal groove 42 at right angles thereto. Positioned within the longitudinal and lateral grooves are corresponding sets of chrome-plated balls 48 of uniform diameter, e.g., of ball bearing type which extend along the lengths of the grooves in contiguous relationship. A circular aperture 31 is provided in end cap 30, and aligns with longitudinal groove 42 for presenting an end ball 48' for being pressed against by knob 34**.

End ball 48' is contacted by an inner surface of knob 34 for applying pressure against the ball, upon selective tightening of knob 34, to transfer pressure to others of the balls for causing them to apply pressure outwardly upon sleeve 14 for producing outward expansion thereof. Each of the lateral grooves **46*a*, 46*b* and 46*c* is of stepped configuration, as illustrated in FIG. 3, to provide space for pairs of the balls on opposite sides of the longitudinal groove 42. The spacing of the balls is such that inner ones of these pairs of balls, such as that illustrated at 48" (FIG. 1) will nest precisely between, and will contact, a pair of the balls in the longitudinal slot 42; and such relationship applies to the balls in the lateral grooves 46*b* and 46*c*. An inner end ball of those in the longitudinal slot 42 is nested between opposite inner balls of those in lateral slot 46*a***.

Accordingly, pressure applied to ball 48' by tightening of knob 34 will force the pairs of balls in each of the laterals slots outward from longitudinal slot 42 for applying pressure against the inner surface of sleeve 14, which thereby bends in the reduced thickness portion 40 to slightly widen gap 38 and tightly and grippingly engage the interior surfaces of the core or other device received upon sleeve 14.

Accordingly, it is seen that there is required to be at least a first set of balls spaced around the coreholder body, i.e., the balls in any of lateral slots, and a further set of balls, i.e., those in the longitudinal slot in intersecting relationship with the first set, whereby pressure exerted relatively between balls in the longitudinal slot will force balls in the lateral slot, or slots, outwardly against the sleeve for expansion thereof. FIG. 5 indicates the stepped character of the lateral grooves **46*c* in greater detail, showing that steps, as at 50, 52**, are formed in the floor, and such steps each have a leading edge of arcuate shape.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. Apparatus for securely holding for rotation a device having a circular central opening, comprising a coreholder body of generally cylindrical configuration, an expandable sleeve surrounding the coreholer body for receiving the device with the sleeve extending within the central opening of the device, the coreholder body defining grooves along its surface beneath the sleeve, a plurality of balls of uniform diameter extending along the lengths of the grooves in contiguous relationship, at least one of the grooves presenting an end one of the balls for pressure thereagainst, and means for selectively applying pressure against the presented ball to transfer pressure to others of the balls for causing the balls to apply pressure to the sleeve for producing outward expansion thereof for uniformly and grippingly engaging interior surfaces of the device central opening.

2. A coreholder for securely holding web cores and the like for winding or unwinding thereof, comprising a body of generally cylindrical configuration, an expandable sleeve surrounding the body for receiving a core with the sleeve extending within the central opening of the core, the body defining grooves along its surface beneath the sleeve, a plurality of balls of uniform diameter extending along the lengths of the grooves in contiguous relationship such that at least some of the balls will be forced radially outward toward the sleeve for applying pressure thereto upon pressure exerted relatively between the balls, at least one of the grooves opening from the body at one end thereof for exposing an end one of the balls, and means for selectively applying pressure against the exposed ball to transfer pressure to others of the balls for causing the balls to apply pressure to the sleeve for producing outward expansion thereof for uniformly and grippingly engaging interior surfaces of the core central opening.

3. A coreholder as set forth in claim 2, there being at least a first set of the balls spaced around portions of the body and a further set of the balls spaced along at least part of the length of the body in intersecting relationship with the first set, whereby pressure exerted relatively between balls of the further set will cause pressure between balls of the first set for forcing balls of the first set outwardly against the sleeve for expansion thereof.

4. A coreholder as set forth in claim 3 wherein balls of the further set of balls is seated within a longitudinal groove extending along at least a major portion of the length of the body, said first set of balls being constituted by one of sets of balls in a corresponding plurality of lateral grooves transecting the longitudinal groove, each of the lateral grooves extending in opposite directions across the longitudinal groove at right angles thereto.

5. A coreholder as set forth in claim 4 wherein each of the lateral grooves includes a floor formed by steps.

6. A coreholder as set forth in claim 2 wherein the sleeve is split along its length for providing a narrow gap formed between opposing edges, said longitudinal groove of the body being positioned beneath the gap.

7. A coreholder as set forth in claim 6 wherein the sleeve is provided along its length with a narrow groove diametrically opposite from the gap for providing thereby a reduced thickness area having increased flexible bending within the reduced thickness area.

8. A coreholder as set forth in claim 2 wherein the body carries a flange at an inner end and a threaded collar at the opposite, outer end, said means for selectively applying pressure comprising a tightening knob threaded upon the collar.

9. A coreholder as set forth in claim 8 wherein the flange includes an outer surface, and carries upon said outer surface an annular disk of frictional material by which drive apparatus may apply rotational frictional forces to the coreholder for rotational acceleration and deceleration thereof.

* * * * *